United States Patent [19]

Kitagawa

[11] Patent Number: 4,990,419

[45] Date of Patent: Feb. 5, 1991

[54] FUNCTION SEPARATION TYPE ELECTROPHOTOGRAPHIC PHOTORECEPTOR COMPRISING ARSENIC, SELENIUM AND TELLURIUM

[75] Inventor: Seizou Kitagawa, Matsumoto, Japan

[73] Assignee: Fuji Electric Co., Ltd., Kawasaki, Japan

[21] Appl. No.: 497,823

[22] Filed: Mar. 22, 1990

Related U.S. Application Data

[63] Continuation of Ser. No. 368,238, Jun. 16, 1989, abandoned.

[30] Foreign Application Priority Data

Jun. 16, 1988 [JP] Japan ..... 63-148988

[51] Int. Cl.[5] ..... G03G 5/14

[52] U.S. Cl. ..... 430/58; 430/67; 430/85

[58] Field of Search ..... 430/58, 67, 85

[56] References Cited

U.S. PATENT DOCUMENTS

| | | | |
|---|---|---|---|
| 4,287,279 | 9/1981 | Brown et al. | 430/58 |
| 4,314,014 | 2/1982 | Yamamoto et al. | 430/57 |
| 4,330,610 | 5/1982 | Hewitt | 430/126 |
| 4,338,387 | 6/1982 | Hewitt | 430/58 |
| 4,338,387 | 7/1982 | Hewitt | 430/58 |
| 4,379,820 | 4/1983 | Nakamura et al. | 430/58 |
| 4,379,821 | 4/1983 | Lutz et al. | 430/58 |

FOREIGN PATENT DOCUMENTS

| | | |
|---|---|---|
| 2850001 | 5/1979 | Fed. Rep. of Germany . |
| 3046509 | 8/1981 | Fed. Rep. of Germany . |
| 3337814 | 4/1984 | Fed. Rep. of Germany . |

*Primary Examiner*—David Welsh

*Attorney, Agent, or Firm*—Brumbaugh, Graves, Donohue & Raymond

[57] ABSTRACT

An improved electrophotographic photoreceptor of a function separation type for long wavelength light is provided which comprises an $As_2Se_3$ carrier transport layer, a 30 to 50 wt % Te-Se alloy carrier generation layer and an $As_2Se_3$ surface protective layer and an outer layer of a transparent insulating material.

3 Claims, 1 Drawing Sheet

FUNCTION SEPARATION TYPE ELECTROPHOTOGRAPHIC PHOTORECEPTOR COMPRISING ARSENIC, SELENIUM AND TELLURIUM

This application is a continuation of application Ser. No. 07/368,238, filed on June 16, 1989, now abandoned.

BACKGROUND OF THE INVENTION

The present invention relates to an electrophotographic photoreceptor of a function separation type for long wavelength light which comprises an Ashd $2SE_3$ carrier transport layer, a 30 to 50 wt% Te-Se alloy carrier generation layer and an As $_2SE_3$ surface protective layer.

In the printer of an electrophotographic system, light of long wavelength, such as 630 to 800 nm, is used as writing light for forming an electrostatic latent image on the surface of a photoreceptor. In such a printer, a function separation type photoreceptor composed of a carrier generation layer that has a high sensitivity even to long wavelength light, a carrier transport layer for transporting the carrier produced on the carrier generation layer, and a surface protective layer for protecting the carrier generation layer from external stress are generally used. In such a photoreceptor, a high-concentration Te-Se alloy is generally used for the carrier generation layer, amorphous Se material is generally used for the carrier transport layer and a low-concentration As-Se alloy is generally used for the surface protective layer. The surface protective layer is an important layer that determines the life of a photoreceptor. However, a low concentration As-Se alloy, which has a high thermal expansion coefficient as compared with $As_2SE_3$ and a low mechanical strength, is generally used in order to avoid cracking due to differences in the thermal expansion coefficients of the surface protective layer and the carrier transport layer, which generally comprise amorphous Se material having a very large thermal expansion coefficient.

Such a photoreceptor disadvantageously has an insufficient printing durability. In an effort to enhance the mechanical strength of the surface protective layer by simultaneously lowering the thermal expansion coefficients of the carrier transport layer and the surface protective layer, an Se-Te-As function separation type photoreceptor for a laser beam printer having a high printing durability has recently been developed.

Such an Se-Te-As photoreceptor realizes a high printing durability on the same level as a conventional $As_2SE_3$ photoreceptor, since the outermost surface layer consists of an As alloy. On the other hand, this photoreceptor also has the same disadvantage of an $As_2SE_3$ photoreceptor, namely when exterior mechanical stress or chemical action are applied, the printing quality deteriorates. For example, image defects are produced.

Accordingly, it is an object of the present invention to eliminate the above-described defects in the prior art and to provide an electrophotographic photoreceptor having a high-printing durability, excellent mechanical strength and chemical stability, thereby reducing the possibility of producing image defects even if mechanical stress or chemical action are applied to the surface of the photoreceptor.

SUMMARY OF THE INVENTION

To achieve this aim, the present invention provides an electrophotographic photoreceptor comprising an $As_2SE_3$ carrier transport layer, a carrier generation layer composed of a selenium-tellurium alloy layer having a high tellurium concentration, and an $As_2SE_3$ surface protective layer covered with a transparent insulation layer.

DETAILED DESCRIPTION OF THE INVENTION

The claimed invention relates to an electrophotographic photoreceptor having excellent mechanical strength and chemical stability which does not produce cracking even at high temperatures and reduces the possibility of producing image defects even when mechanical stress or chemical action are applied to the surface of the photoreceptor. The claimed photoreceptor comprises, in sequence, a conductive base, a carrier transport layer comprising $As_2SE_3$, a carrier generation layer comprising a tellurium-selenium alloy having a high tellurium content, a carrier injection regulating layer, a surface protective layer comprising $As_2SE_3$ and a transparent insulation layer.

Figure 1:
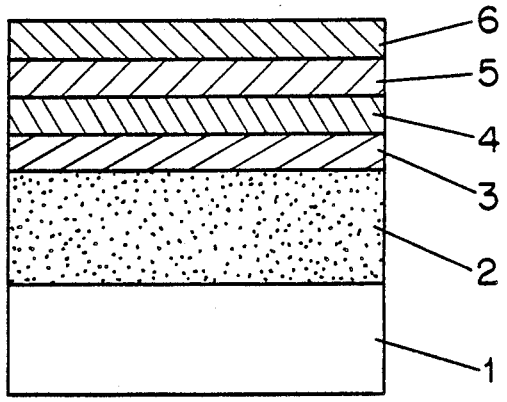
FIG. 1 is a sectional view of an embodiment of an electrophotographic photoreceptor according to the present invention.
Figure 2:
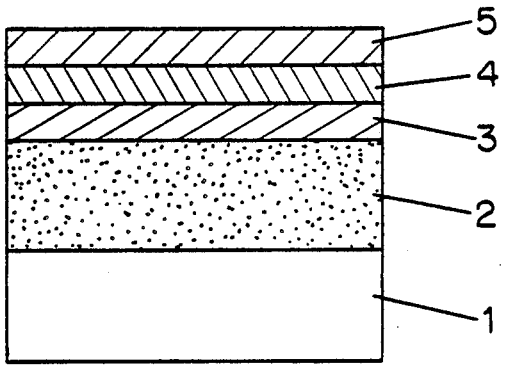
FIG. 2 is a sectional view of the structure of a comparative example.

FIG. 1 shows the structure of an embodiment of an electrophotographic photoreceptor according to the present invention. A carrier transport layer 2 and a carrier generation layer 3 are laminated on a conductive base 1. A carrier injection regulating layer 4 composed of a material having a wider band gap than the carrier generation layer 3 is provided on the carrier generation layer 3 and a surface protective layer 5 is provided thereon. The surface protective layer 5 is covered with a transparent insulation layer 6, which is characteristic of the present invention.

An $As_2SE_3$ alloy having a thickness of 50 to 80 μm is preferably used as the carrier transport layer 2. For the carrier generation layer 3, the Te concentration and the thickness are determined by the wavelength of light used for the exposure of an image. Preferably, a 0.1 to 1 μm thick film of a material having a Te concentration of 30 to 50 wt% is used for the carrier generation layer 3.

The carrier injection regulating layer 4 is preferably composed of an As-Se alloy containing about 5% by weight As having a wider band gap than the 30 to 50 wt% Te-Se alloy. The carrier injection regulating layer 4 preferably has a thickness of about 0.1 to 2 μm.

The surface protective layer 5 is composed of an $As_2SE_3$alloy having a thickness of 2 to 5 μm. A transparent insulating material having an excellent durability and a high resistance should be used for the transparent insulation layer 6 provided on the surface protective layer 5. Preferably the resistance of the material should be about $10^{12}$ Ωcm. Suitable materials for the transparent insulation layer 6 include metal oxides such as $Al_2O_3$, $SiO_3$ and $Ta_2O_5$, and synthetic resins comprising nylon, urethane, silicon compounds and the like. The film thickness of the transparent insulating material 6 is preferably 0.5 to 1 μm in the case of a metal oxide, and 1 to 3 82 m in the case of a synthetic resin, taking into account image blur, reduction in the concentration in the printer and the printing durability.

The following non-limiting examples describe three types of photoreceptors, including two having the abovedescribed structure as well as a comparative example.

EXAMPLE 1

In this photoreceptor, the transparent insulation layer was composed of $Al_2O_3$.

In order to manufacture this photoreceptor, an aluminum cylinder 80 mm in diameter which had been machined and washed was attached to a shaft in evaporation equipment, and an $As_2SE_3$ alloy was deposited on the aluminum cylinder as the carrier transport layer. The temperature of the shaft was 190° C, the vacuum degree was $1 \times 10^{31\ 5}$ Torr and the temperature of the evaporation source was 400° C. The carrier generation layer, the carrier injection regulating layer and the surface protective layer were deposited by flash deposition. The resulting photoreceptor was charged into an arc type ion plating apparatus, and the transparent insulation layer of $Al_2O_3$ was deposited to a thickness of about 0.8 μm by ion plating while the substrate temperature was 60° C, the ionizing voltage was 50 V, the substrate voltage was 20 V and the vacuum degree was $1 \times 10^{-5}$ Torr

EXAMPLE 2

In this photoreceptor the transparent insulation layer was composed of a synthetic resin containing nylon, urethane and a silicon compound.

The photoreceptor, up to the formation of the transparent insulation layer, was prepared in the same way as described above in Example 1. The transparent insulation layer was produced by applying a mixed solution of nylon, urethane, and a silicon compound to the surface protective layer of the $As_2SE_3$ to a thickness of about 3 μm, and drying and curing the coated layer at 50° C for 2 hours.

EXAMPLE 3

The photoreceptor in this comparative example was manufactured in the same way as in the photoreceptors of Examples 1 and 2 except that a transparent insulation layer was not included in this photoreceptor.

In order to evaluate the mechanical stress and the chemical stability of these photoreceptors, each of the photoreceptors was scratched by a 2H pencil and an individual's finger was pressed thereon to leave a fingerprint. The production of image defects was then examined. A thermal resistance test was also carried out by storing the photoreceptors at 45° C. for 1000 hours. Finally, the printing durability was examined.

While an image defect was produced on the photoreceptor of Example 3 due to the scratch of the pencil and the fingerprint, no image defects were produced on the photoreceptors of Examples 1 and 2. The thermal resistance and the printing durability were the same for all the photoreceptors. It is therefore clear that the electrophotographic photoreceptors of the present invention have both good mechanical strength and chemical stability.

I claim:

1. An electrophotographic photoreceptor comprising, in sequence:
   (a) a conductive base;
   (b) a carrier transport layer comprising $As_2SE_3$;
   (c) a carrier generation layer comprising a tellurium-selenium alloy;
   (d) a carrier injection regulating layer;
   (e) a surface protective layer comprising $As_2SE_3$ and
   (f) a transparent insulation layer.

2. The electrophotographic photoreceptor according to claim 1, wherein the carrier generation layer comprises 30 to 50% by weight tellurium.

3. The electrophotographic photoreceptor of claim 1, wherein the transparent insulation layer comprises a material selected from the group consisting of $Al_2O_3$, $SiO_3$, $Ta_2O_5$, nylon, urethane and silicon compounds.

* * * * *